US005746121A

United States Patent [19]

Zimmer

[11] Patent Number: 5,746,121

[45] Date of Patent: May 5, 1998

[54] METHOD OF COMPACTING TRASH ON A PLATFORM

[76] Inventor: John Zimmer, 4308 W. Admiral Doyle Dr., New Iberia, La. 70506

[21] Appl. No.: 681,317

[22] Filed: Jul. 22, 1996

Related U.S. Application Data

[63] Continuation of Ser. No. 388,627, Feb. 14, 1995, abandoned.

[51] Int. Cl.[6] ..... B30B 1/32

[52] U.S. Cl. ..... 100/35; 100/226; 100/229 A

[58] Field of Search ..... 100/226, 229 A, 100/35

[56] References Cited

U.S. PATENT DOCUMENTS

| | | | |
|---|---|---|---|
| 2,757,603 | 8/1956 | Wilson et al. | 100/226 |
| 3,613,567 | 10/1971 | Loughran | 100/226 |
| 3,687,068 | 8/1972 | Loughran | 100/226 |
| 3,910,181 | 10/1975 | Andrews et al. | 100/226 |
| 4,080,889 | 3/1978 | Shiloni | 100/226 |

FOREIGN PATENT DOCUMENTS

| | | | |
|---|---|---|---|
| 1090368 | 3/1955 | France | 100/226 |
| 2305778 | 8/1974 | Germany | 100/226 |
| 2232635 | 12/1990 | United Kingdom | 100/226 |

*Primary Examiner*—Stephen F. Gerrity
*Attorney, Agent, or Firm*—Joseph T. Regard Ltd.

[57] ABSTRACT

A trash compaction system which includes a lower container portion for receiving trash thereinto, a ram member positionable over an open top end of the container, the ram member hydraulically lowerable into the container space, so as to compact trash within the container space; a support frame upon which the ram member is supported between an upper position above the container space to a lowered, compacting position within the container space; track members extending horizontally outward from the upper edge of the container; rollers on the frame of the ram, the rollers riding on the track members, so that when the ram is in the upper position, the ram may be rolled along the track members to a position aside from the container so as to expose the opening of the container for dropping trash therewithin.

3 Claims, 2 Drawing Sheets

METHOD OF COMPACTING TRASH ON A PLATFORM

CROSS REFERENCE TO RELATED APPLICATION

This application is a continuation of application Ser. No. 08/388,627, filed Feb. 14, 1995, now abandoned.

BACKGROUND OF THE INVENTION

1. Field of the Invention

The apparatus of the present invention relates to compactors. More particularly, the present invention relates to a trash compactor which because of its design roll-back features may be positioned in a very confined space, yet perform compaction tasks effectively.

2. General Background

In the current art of compaction systems, there are various designs of compactors which attempt to address certain concerns, many of which are environmental in nature. However, one of the most difficult problems to address is the positioning of a trash compaction system within or upon a very confined space, yet obtain desired results in trash compaction. For example, in the oil field industry, offshore drilling and production is conducted from a platform set within oftentimes thousands of feet of water. In order to conduct the business, there are vital components which must be on the platform, including everything from the rig itself to the living quarters of the rig workers. Additionally, the environmental requirements are such that no trash may be dumped off of the platform into the open water. Therefore, over a long period of time, trash accumulates very quickly. Thus, an automatic compaction system would be beneficial to reducing the bulk of the trash. However, because of space requirements for more vital components, trash compactors, which for industrial purposes, are quite large and expansive, cannot be used on such a confined space such as a rig floor.

Therefore, there is a need in the art for a trash compaction system which may be utilized within a confined area, yet deliver the ability to compact a volume of trash within the confined space, as would a normally very large compactor.

SUMMARY OF THE PRESENT INVENTION

The system of the present invention solves the problems in the art in a simple and straightforward manner. What is provided is a trash compaction system which includes a lower container portion for receiving trash thereinto, a ram member positionable over an open top end of the container, the ram member hydraulically lowerable into the container space, so as to compact trash within the container space; a support frame upon which the ram member is supported between an upper position above the container space to a lowered, compacting position within the container space; track members extending horizontally outward from the upper edge of the container; rollers on the frame of the ram, the rollers riding on the track members, so that when the ram is in the upper position, the ram may be rolled along the track members to a position aside from the container so as to expose the opening of the container for dropping trash therewithin.

Therefore, it is a principal object of the present invention to provide a compactor that takes up only the space defined by the compaction trash receiving chamber;

It is a further principal object of the invention to provide a trash compactor which can be positioned on the edge of a rig floor, and which allows the ram member to move laterally from a position above the trash receiving chamber, along track members, and be supported on the tracks above the water, thus taking no floor space, while the container is free and open to receive trash;

It is a further object of the present invention to provide a trash compactor which allows the ram member to move laterally along track members when the ram is out of the container, so that trash can be placed into the container, and the ram is supported on tracks extending from the support surface, such as a rig floor, and not occupying valuable rig space;

It is a further object of the present invention to provide a compactor which occupies substantially only the square footage of the container itself, and does not require additional square footage to accommodate the ram when the ram has been moved from the container space to receive trash therein.

DETAILED DESCRIPTION OF THE PREFERRED EMBODIMENT

Figure 1:
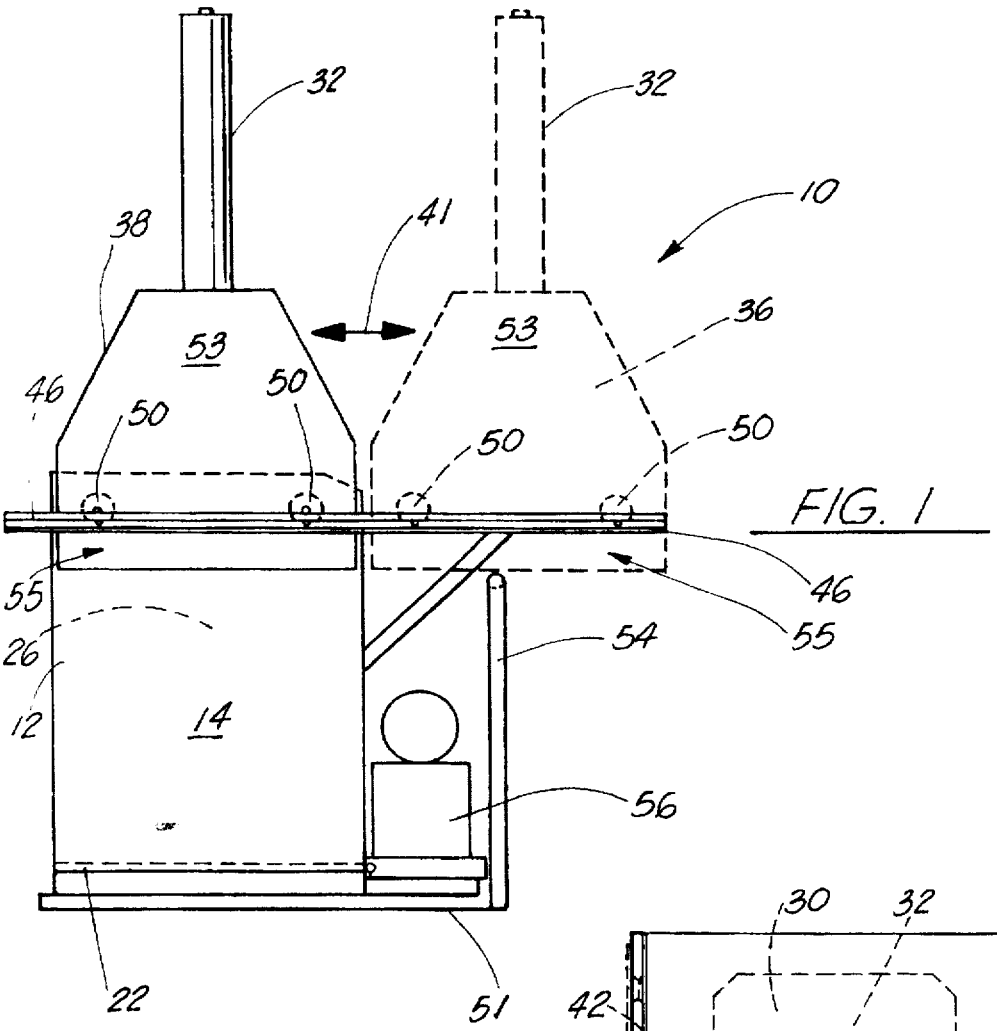
FIG. 1 is an overall side view of the preferred embodiment of the present invention.

The preferred embodiment of the apparatus of the present invention is illustrated by the numeral 10. Apparatus 10 comprises a container 12, having four side walls 14, 16, 18, 20, a floor portion 22, and an open top 24, all defining a trash container space 26 therein. Positioned above container 12 would be a compaction means 28. This means 28 comprises a ram member 30, being of a configuration to be received within the container space 26, when the ram member 30 is moved downward into container space 26 by the hydraulic cylinder 32. As in all compactors, there is a very little clearance between the walls of the container 12 and the side walls 34 of the ram member 30, as it moves down the container space 26. As further illustrated, again, as with most compactors, the ram 30 and the hydraulic cylinder 32 are supported by a frame means 36, which, in this embodiment includes an outer, upper extending frame portion 38, and a lower frame portion 40, which comprises a pair of members 42, 44 spaced apart to support the movement of ram 30 in its upward and downward path.

Figure 3:
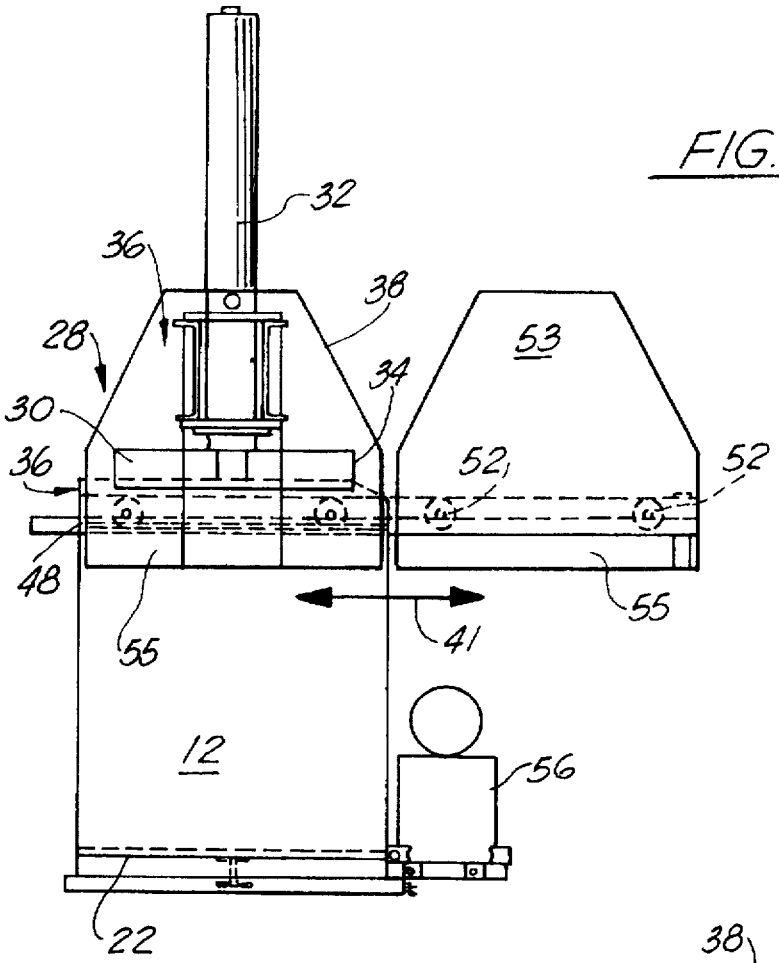
FIG. 3 is a side, cutaway view of the preferred embodiment of the present invention.
Figure 4:
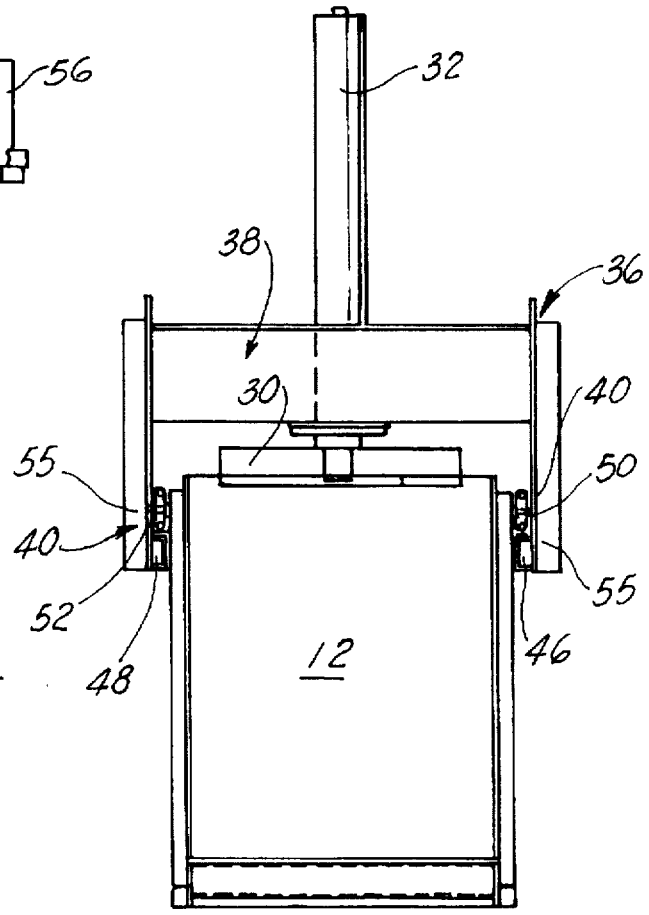
FIG. 4 is an end, cutaway view of the preferred embodiment of the present invention.

As further illustrated in the drawings, the container 12 is generally of a square in cross section, and has a thickened walls so as to withstand the force of compaction. Further, the compaction apparatus 10 comprises a means to allow the ram 30 and the frame means 36 to move laterally, as seen by arrow 41, in relation to the container 12, as illustrated in FIGS. 1 and 3. This lateral movement is achieved by a pair of track members 46, 48, which are secured to and extending outward from opposite walls 14, 18 of the container 12, and which are secured also to the frame means 36. The tracks extend outward from the wall of the container 12, at least a distance which would define and additional width of the container 12, as will be explained. As seen further in the figures, there is a shield member 53 secured to frame means 36, with shield member 53 including a pair of skirts 55, which overlap the top of container 12, so that when the frame means 36, with ram 30 is positioned over the top 24 of container 12, shield 53, and skirts 55 cover the top 24 of container 12 during the compaction process.

Figure 2:
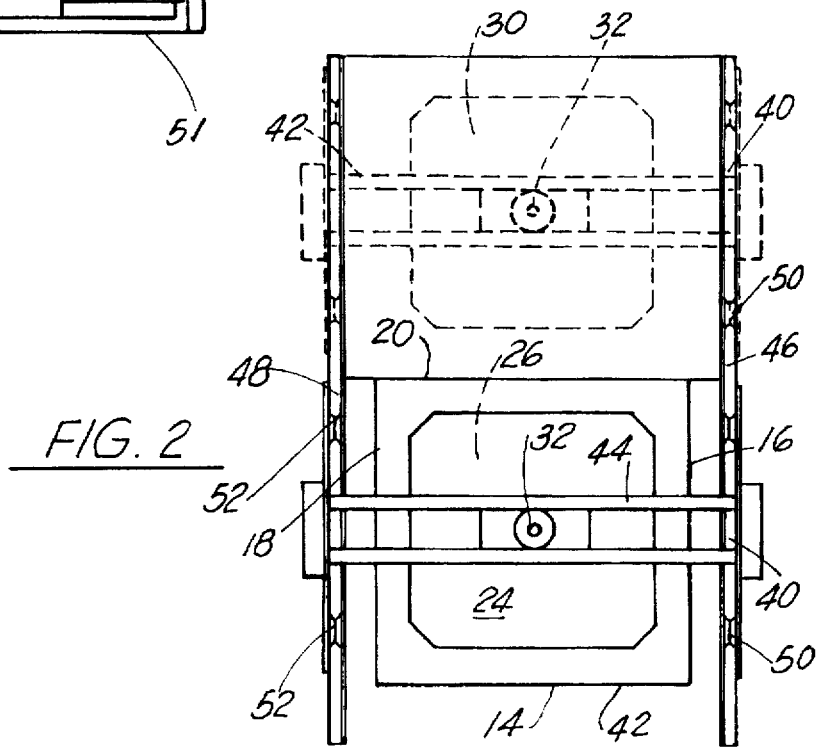
FIG. 2 is an overall top view of the preferred embodiment of the present invention.

The track members 46, 48 would each accommodate two pairs of rollers 50, 52, each pair of rollers rotatably attached to the lower portion 40 of frame means 36. Therefore, as seen in the figures, the rollers 50, 52 positioned upon track members 46, 48, would allow the frame means 36, and the ram 30 housed within frame means 36 to move laterally away from the container 12 when the ram 30 is in the up position, as seen in FIGS. 2 and 3. In this position, the upper opening 24 of container 12, no longer has ram 30 in position to block the opening 24, and trash can be thrown therein. Furthermore, and more importantly, as seen in FIG. 1, by allowing the ram 30 and frame means 36 to move laterally and be supported by tracks 46, 48, that portion of the tracks 46, 48 may extend outward beyond the edge of the deck 51 of the rig, and over the guard rail 54. OSHA standards require that the rail be at least 42 inches in height. Therefore, although the ram 30 is almost as large as the container 12, when it is rolled away from the container 12, it is supported off of the rig deck 51, and does not occupy valuable rig space. When the container 12 is filled, and ready for compaction, the ram 30 and frame means 36 are simply rolled back and returned to position over the container 12, and the ram 30 may be activated hydraulically to compact the trash within the container 12.

As is evident from the drawings, the only other space occupied by the system is the hydraulic motor 56, which powers the hydraulic ram 32, and is positioned adjacent container 12, and occupies very little space, as is illustrated. This system, although specially designed for oil rigs, may be used anywhere the space requirements are rigorous, yet trash compaction is an essential need.

As many possible embodiments may be made of the apparatus of this invention without departing from the scope thereof, it is to be understood that all matter herein set forth or shown in the accompanying drawings is to be interpreted as illustrative and not in a limiting sense.

What is claimed as invention is:

1. A method of compacting trash upon the edge of a platform having a periphery having a guard rail situated about said periphery, said guard rail having a height, comprising the steps of:

(a) providing a container for receiving said trash to be compacted, said container having an open top and opposing walls;

(b) providing a compaction member moveable in a vertical position, releasably engaging said compaction member to said container, configuring said compaction member so that it may migrate downward into said container so as to compact said trash in a down position, and return to an up position out of said container;

(c) providing power means for urging said compaction member through said up and down positions;

(d) providing a support frame for supporting said compaction member;

(e) engaging a pair of track members along said opposing walls of said container, said track members movably engaging said support frame via a plurality of rollers in such a manner as to support said compaction member movably engaged upon said pair of track members;

(f) providing a shield member secured about said support frame, said shield member configured to envelope said compaction member and said open top of said container when said compaction member is in said compacting position;

(g) urging said compaction member, while in said up position, along with said support frame, to move along said track members laterally away from said container, placing said container in a loading position, and said compaction member is supported above said guard rail and beyond the periphery of said platform such that said open top of said container is exposed for receiving trash;

(h) placing an amount of trash into said open top of said container;

(i) returning said compaction member and said frame to a compacting position, allowing said frame and power means to straddle said open top of said container;

(j) allowing said shield member to envelope said compaction member and said open top of said container; and (k) actuating said power means for urging said compacting member into said container, so as to compact said trash in said container.

2. A method of compacting trash upon a platform having a guard rail thereon, said guard rail having a height, comprising the steps of:

(a) providing a container for receiving said trash to be compacted, said container having an open top and opposing walls;

(b) providing a compaction member moveable in a vertical position, configuring said compaction member so that it may migrate downward into said container so as to compact said trash in a down position, and return to an up position out of said container;

(c) providing power means for urging said compaction member through said up and down positions;

(d) providing a support frame for supporting said compaction member;

(e) engaging a pair of track members adjacent to said opposing walls of said container, said track members movably engaging said support frame via a plurality of rollers in such a manner as to support said compaction member movably engaged upon said pair of track members;

(f) urging said compaction member, while in said up position, along with said support frame, to move along said track members away from said container, placing said container in a loading position, and supporting said compaction member above said guard rail such that said open top of said container is exposed for receiving trash;

(g) placing an amount of trash into said open top of said container;

(h) returning said compaction member and said frame to a compacting position, allowing said frame and power means to straddle said open top of said container; and (i) actuating said power means for urging said compacting member into said container, so as to compact said trash in said container.

3. A method of compacting trash upon the edge of a platform having a guard rail thereon, said guard rail having a height, comprising the steps of:

(a) providing a container for receiving said trash to be compacted, said container having an open top and opposing walls;

(b) providing a compaction member moveable in a vertical position, configuring said compaction member so that it may migrate downward into said container so as to compact said trash in a down position, and return to an up position out of said container;

(c) providing power means for urging said compaction member through said up and down positions;

(d) providing a support frame for supporting said compaction member;

(e) engaging a pair of track members adjacent to said opposing walls of said container, said track members movably engaging said support frame via a plurality of rollers in such a manner as to support said compaction member movably engaged upon said pair of track members;

(f) urging said compaction member, while in said up position, along with said support frame, to move along said track members away from said container, placing said container in a loading position, and supporting said compaction member above said guard rail such that said open top of said container is exposed for receiving trash;

(g) placing an amount of trash into said open top of said container;

(h) returning said compaction member and said frame to a compacting position, allowing said frame and power means to straddle said open top of said container, over said edge of said platform; and (i) actuating said power means for urging said compacting member into said container, so as to compact said trash in said container.

* * * * *